US011647853B1

(12) United States Patent
Newland

(10) Patent No.: US 11,647,853 B1
(45) Date of Patent: May 16, 2023

(54) RING FOR HOLDING KNIFE INSIDE JAR

(71) Applicant: Ryan P Newland, Barrington, IL (US)

(72) Inventor: Ryan P Newland, Barrington, IL (US)

( * ) Notice: Subject to any disclaimer, the term of this patent is extended or adjusted under 35 U.S.C. 154(b) by 0 days.

(21) Appl. No.: 16/947,665

(22) Filed: Aug. 11, 2020

(51) Int. Cl.
*A47G 19/18* (2006.01)
*A47G 21/14* (2006.01)

(52) U.S. Cl.
CPC ..... *A47G 19/186* (2013.01); *A47G 21/145* (2013.01)

(58) Field of Classification Search
CPC ..... A47G 19/186; A47G 19/2222; A47G 19/2266; A47G 19/2272; A47G 19/18; A47G 21/145; B26B 3/00; B26B 29/025; B65D 1/10; B65D 23/12; B65D 43/0231; B65D 51/246; B65D 51/32; B65D 77/245; A47J 43/287
See application file for complete search history.

(56) References Cited

U.S. PATENT DOCUMENTS

| | | | | |
|---|---|---|---|---|
| 277,467 | A | 6/1883 | Quillfeldt | |
| 317,950 | A | 5/1885 | Lilly | |
| 787,986 | A | 4/1905 | Keliher | |
| 1,017,753 | A | 2/1912 | Harrison | |
| 1,021,004 | A | 5/1912 | Sanford | |
| 1,327,439 | A | 6/1920 | Lewis | |
| 1,383,603 | A | 7/1921 | Craig | |
| 1,834,085 | A | 12/1928 | Bloom | |
| 1,875,379 | A | 9/1930 | Holmes | |
| 1,840,662 | A * | 1/1932 | Fischer | B65D 51/32 401/128 |
| 2,124,929 | A | 8/1935 | Reid | |
| 2,149,698 | A * | 3/1939 | Humphrey | B65D 51/246 141/112 |
| 2,665,029 | A | 3/1951 | Horrocks | |
| 2,738,900 | A | 2/1954 | Wegner | |
| 2,803,030 | A | 4/1954 | Florio | |
| 2,920,779 | A | 10/1956 | Armitage | |
| 3,022,916 | A | 9/1960 | Spooner | |
| 3,144,152 | A | 8/1964 | Kopp | |
| 3,955,742 | A | 5/1976 | Marshall | |
| 4,001,444 | A | 1/1977 | Clarke | |

(Continued)

FOREIGN PATENT DOCUMENTS

| | | | |
|---|---|---|---|
| BE | 1007748 A3 * | 10/1995 | A47G 19/186 |
| BE | 1007748 A3 | 10/1995 | |

(Continued)

OTHER PUBLICATIONS

English Abstract for BE1007748A3.

(Continued)

*Primary Examiner* — J. Gregory Pickett
*Assistant Examiner* — Abigail Elizabeth Guidry
(74) *Attorney, Agent, or Firm* — Patents and Licensing LLC; Daniel W Juffernbruch

(57) ABSTRACT

A ring for holding a handheld spreader of a container for holding spreadable food is shaped to be press fit into a top mouth opening of an inside surface of the container. A holder is formed on an inner surface of the right and having at least a top slit opening sized to receive the handheld spreader of a substantially flat shape. The handheld spreader has a bent handle area bent approximately ninety degrees on an end and a spreading surface on an opposing end.

20 Claims, 7 Drawing Sheets

(56) References Cited

U.S. PATENT DOCUMENTS

| | | | | |
|---|---|---|---|---|
| 4,095,716 | A * | 6/1978 | Meany | A47G 21/04 215/391 |
| 4,219,283 | A | 8/1980 | Buckley | |
| 4,423,687 | A * | 1/1984 | Serra | E05G 1/08 109/50 |
| 4,717,032 | A | 1/1988 | Wu | |
| D302,793 | S | 8/1989 | Yamaguchi | |
| 4,942,663 | A * | 7/1990 | Ray, Sr. | B26B 29/025 224/183 |
| 5,146,684 | A * | 9/1992 | Hagler | B26B 29/025 224/232 |
| 5,211,322 | A * | 5/1993 | Nealy | B26B 29/025 224/230 |
| 5,236,022 | A | 8/1993 | Husted | |
| 5,251,774 | A | 10/1993 | Engle | |
| 5,291,992 | A | 3/1994 | Olivetti | |
| 5,586,676 | A | 12/1996 | Lynd | |
| 5,738,242 | A | 4/1998 | Paris | |
| 6,578,725 | B2 | 6/2003 | Delman | |
| 6,772,904 | B1 | 8/2004 | Gilliam | |
| 7,464,475 | B2 * | 12/2008 | Tsao | B65D 77/245 215/391 |
| 7,770,745 | B2 | 8/2010 | Weissmann | |
| D674,669 | S * | 1/2013 | Gerli | D7/645 |
| 8,740,012 | B2 | 6/2014 | Ekkert | |
| 8,839,522 | B2 * | 9/2014 | Walters | A47G 21/06 30/142 |
| 10,376,080 | B1 * | 8/2019 | Newland | B26B 3/00 |
| 2005/0029276 | A1 * | 2/2005 | Johnson | A47J 43/28 426/115 |
| 2005/0260026 | A1 * | 11/2005 | Kessler | A45D 40/0075 401/125 |
| 2006/0249639 | A1 * | 11/2006 | Bisceglia | B65D 83/75 248/213.2 |
| 2007/0170188 | A1 * | 7/2007 | Guillaume | B65D 21/0233 220/710 |
| 2007/0266569 | A1 * | 11/2007 | Nenadic | B26B 3/06 30/151 |
| 2008/0149637 | A1 * | 6/2008 | Hanafusa | B65D 51/246 220/212.5 |
| 2008/0217333 | A1 * | 9/2008 | Mayo | A47G 19/186 220/212 |
| 2009/0261113 | A1 | 10/2009 | Miota | |
| 2009/0277902 | A1 * | 11/2009 | Darflinger | B65D 51/246 220/212 |
| 2009/0289070 | A1 * | 11/2009 | Costa | A47G 21/04 220/574.1 |
| 2009/0293898 | A1 | 12/2009 | Young | |
| 2009/0321478 | A1 | 12/2009 | Juteau | |
| 2012/0285845 | A1 * | 11/2012 | Jackson | A47G 19/186 206/223 |
| 2014/0284343 | A1 * | 9/2014 | Allen | A47G 23/0216 220/710 |
| 2014/0299567 | A1 * | 10/2014 | Vogel | B65D 51/246 215/44 |
| 2016/0288352 | A1 * | 10/2016 | Squiers | B26B 29/025 |
| 2017/0043493 | A1 * | 2/2017 | Seber | B26B 29/025 |
| 2018/0022505 | A1 * | 1/2018 | Herlin | B65D 15/08 206/216 |
| 2018/0192802 | A1 | 6/2018 | Johnson | |
| 2018/0186540 | A1 * | 7/2018 | Van | B65D 43/0218 |
| 2018/0257839 | A1 * | 9/2018 | Chevalley | B65D 17/501 |
| 2019/0054642 | A1 * | 2/2019 | Wu | B26B 29/025 |
| 2019/0276208 | A1 * | 9/2019 | Becker | B65D 43/0231 |
| 2021/0331844 | A1 * | 10/2021 | Yan | B65D 51/246 |

FOREIGN PATENT DOCUMENTS

| | | | | |
|---|---|---|---|---|
| DE | 2738960 | A1 | 3/1979 | |
| DE | 3629718 | A1 | 3/1988 | |
| DE | 3900335 | A1 | 8/1989 | |
| DE | 3940429 | A1 | 6/1991 | |
| DE | 29602339 | U1 * | 4/1996 | A47G 21/145 |
| DE | 29713364 | U1 * | 9/1997 | A47G 19/186 |
| DE | 19718043 | A1 | 11/1998 | |
| DE | 19718310 | A1 | 11/1998 | |
| DE | 29817273 | U1 | 12/1998 | |
| DE | 19940739 | A1 | 12/2000 | |
| EP | 0856274 | A1 * | 8/1998 | A47G 21/02 |
| EP | 0922650 | A1 | 6/1999 | |
| EP | 1690476 | A1 | 8/2006 | |
| FR | 2881634 | A1 * | 8/2006 | A47G 19/186 |
| FR | 2905581 | A1 * | 3/2008 | A47G 21/145 |
| GB | 269328 | A * | 4/1927 | A47G 19/186 |
| JP | 2003230475 | A | 8/2003 | |
| WO | WO2000048721 | A1 | 8/2000 | |
| WO | WO-2005037678 | A1 * | 4/2005 | B65D 21/0233 |
| WO | WO-2008041808 | A1 * | 4/2008 | B65D 77/245 |
| WO | WO2009072874 | A1 | 6/2009 | |
| WO | WO2013104780 | A1 | 7/2013 | |
| WO | WO-2015065818 | A1 * | 5/2015 | B65D 23/10 |
| WO | WO-2016203287 | A1 * | 12/2016 | B65D 33/007 |
| WO | WO-2017045086 | A1 * | 3/2017 | B65D 17/501 |
| WO | WO-2017155453 | A1 * | 9/2017 | B65D 51/20 |

OTHER PUBLICATIONS

English Abstract for DE2738960A1.
English Abstract for DE3629718A1.
English Abstract for DE3900335A1.
English Abstract for DE3940429A1.
English Abstract for DE19718043A1.
English Abstract for DE19718310A1.
English Abstract for DE19940739A1.
English Abstract for DE29817273U1.
English Abstract for JP2003230475A.
English Abstract for EP0922650A1.
English Translation for WO2000048721A1.

* cited by examiner

RING FOR HOLDING KNIFE INSIDE JAR

CROSS-REFERENCE TO RELATED PATENT

The present inventions are related to the subject matter of U.S. Pat. No. 10,376,080 granted on Aug. 13, 2019 and first filed on Apr. 28, 2017 by Ryan P Newland and entitled JAR WITH KNIFE SHEATH UNDER LID.

BACKGROUND OF THE INVENTIONS

1. Technical Field

The present inventions relate to container accessories and, more particularly, relate to adaptations for holding utensils inside jars.

2. Description of the Related Art

Typically food jars are stored in a kitchen refrigerator and knifes are stored in a kitchen drawer. Assembling food such as sandwiches require taking a knife from a drawer to spread the food from the jar on bread. Then the knife needs to be washed and returned to the drawer. A next food assembly at another time repeats this process.

What is needed is an apparatus for a more streamlined way of assembling food such as making a sandwich.

BRIEF DESCRIPTION OF THE DRAWINGS

The present inventions are illustrated by way of example and are not limited by the accompanying figures, in which like references indicate similar elements. Elements in the figures are illustrated for simplicity and clarity and have not necessarily been drawn to scale.

The details of the preferred embodiments will be more readily understood from the following detailed description when read in conjunction with the accompanying drawings wherein.

DETAILED DESCRIPTION OF THE PREFERRED EMBODIMENTS

Figure 1:
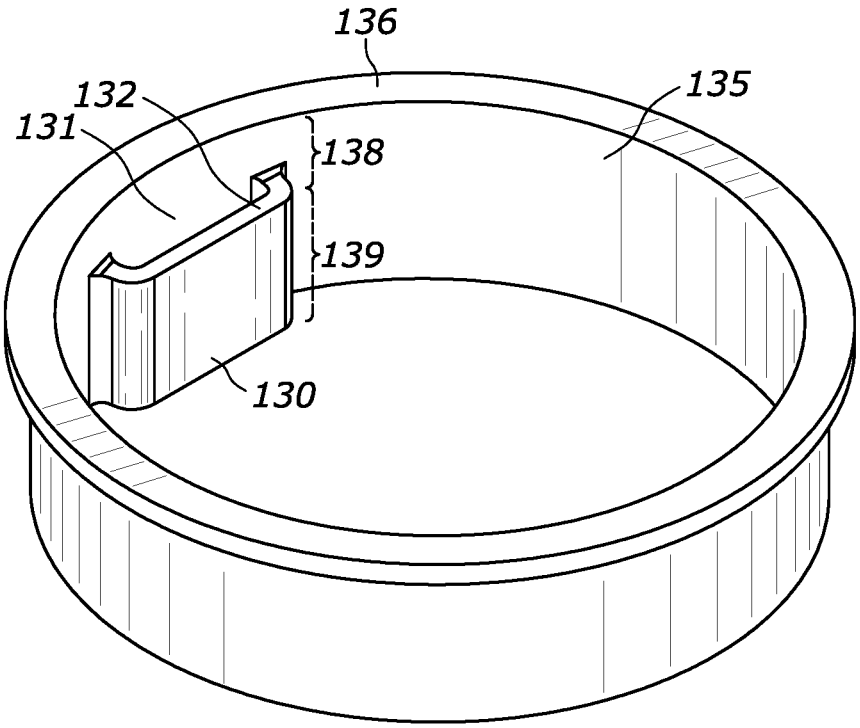
FIG. 1 illustrates a perspective view of ring with sleeve capable of holding a knife in a jar according to a first embodiment of the present inventions.

FIG. 1 illustrates a perspective view of ring 135 with sleeve or sheath 130 capable of holding a handheld spreader knife in a jar according to a first embodiment of the present inventions. The sheath 130 has a top sheath opening 131 at a sheath top 132 of the sheath 130 sized to receive the handheld spreader knife. The sheath top 132 is recessed below a ring top 136 as illustrated by a recess distance 138.

Figure 2:
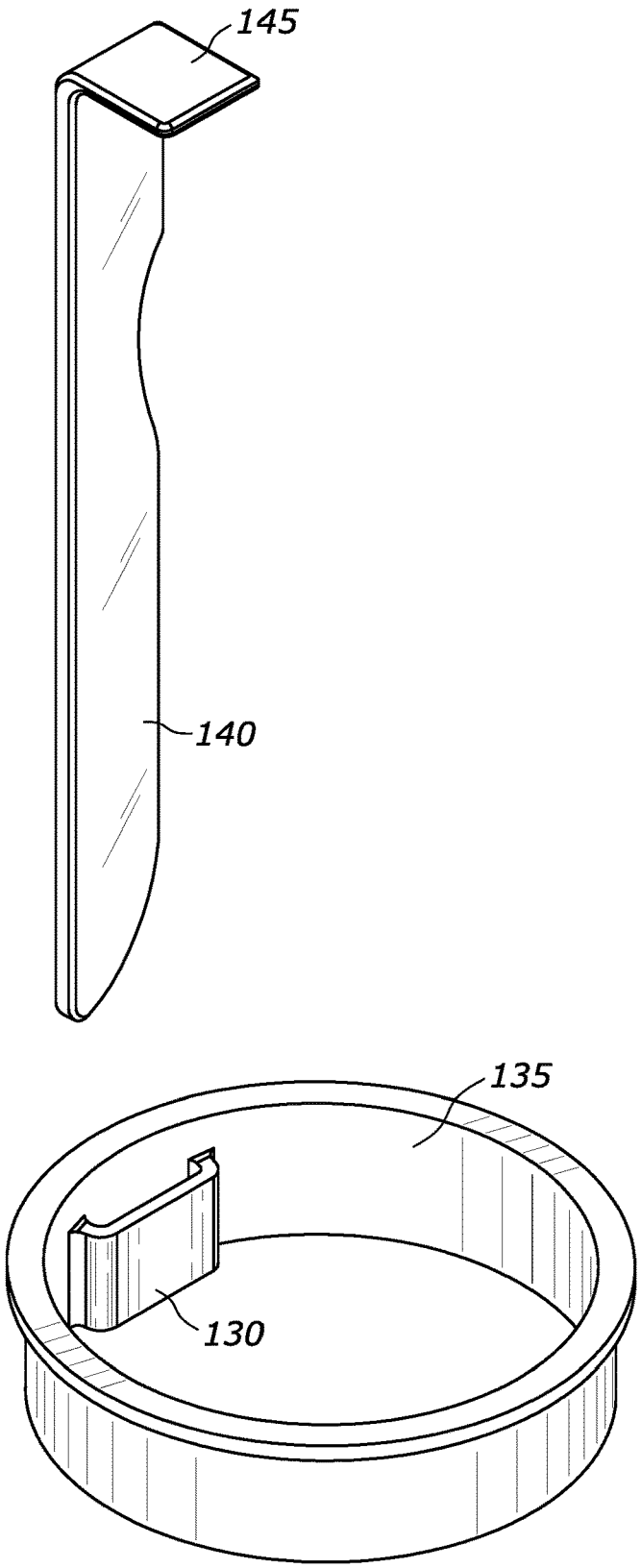
FIG. 2 illustrates a perspective view of a knife and the ring with sleeve capable of holding the knife in a jar according to the first embodiment of the present inventions.

FIG. 2 illustrates a perspective view of a knife 140 and the ring 135 with sleeve 130 capable of holding the knife 140 in a jar according to the first embodiment of the present inventions. The knife 140 has a handle at an upper portion of the length of the knife. The handle preferably contains a 90 degree bent portion 145, as illustrated. The bent portion 145 of the handle on the upper end of the knife 140 aids the fingers of the hand of a user to grasp the knife 140. Additionally, the bent portion 145 acts as a stop to limit the depth the knife 140 travels down when instated into the jar 110. The sheath 130 has a top sheath opening at a top of the sheath 130 sized to receive the handheld spreader knife 140. A top sheath opening of the sheath 130 is configured with a same size and shape as a cross-section of the handheld spreader knife 140 to scrape and clean the handheld spreader knife 140 when the handheld spreader knife 140 is slid in the sheath 130.

Figure 3:
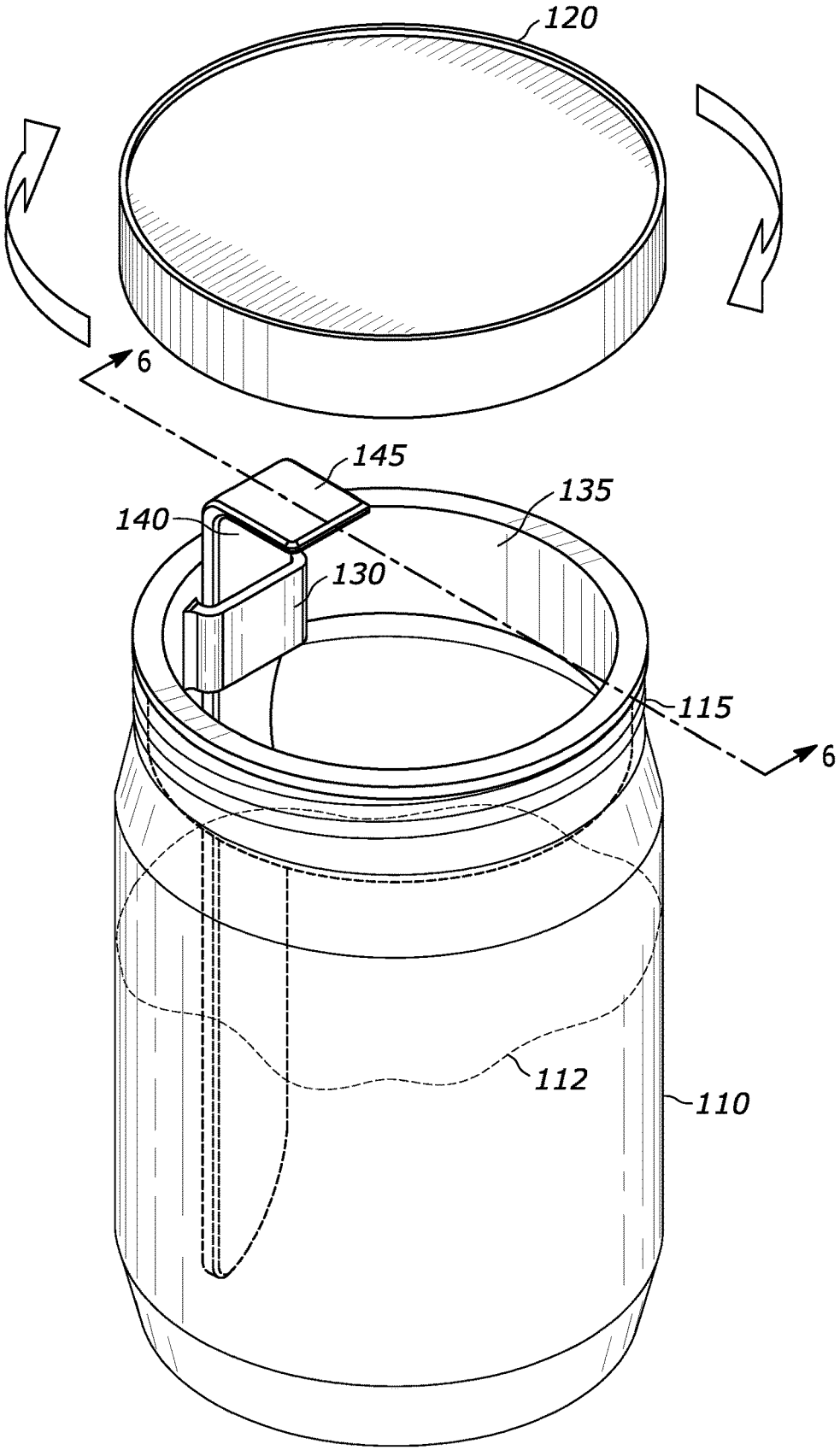
FIG. 3 illustrates a perspective view of a lid and a jar holding the ring with the knife in the sleeve according to the first embodiment of the present inventions.

FIG. 3 illustrates a perspective view of a lid 120 and a container such as a jar 110 holding the ring 135 with the knife 140 in the sleeve 130 according to the first embodiment of the present inventions. The jar 110 has one or more container sides and a bottom attached to the sides defining an inside surface with the top mouth opening. In this first embodiment, the sleeve 130 press fits into the inner annular surface of the mouth 115 of the jar 110. The knife 140 has a handle at an upper portion of the length of the knife. The handle preferably contains a 90 degree bent portion 145, as illustrated. The bent portion 145 of the handle on the upper end of the knife 140 aids the fingers of the hand of a user to grasp the knife 140. Additionally, the bent portion 145 acts as a stop to limit the depth the knife 140 travels down when instated into the jar 110. The bottom tip of the knife 140 can be prevented from touching the bottom of the jar 110 by the stop function of the bent portion of the knife 140. Of course this depends on the length of the knife 140 too. The sleeve 130 and ring 135 holds a handheld spreader such as the knife 140 or other utensil inside the jar 110. The jar 110 holds spreadable food up to the top food level 112. The top food level 112 of the foodstuff or other contents of the jar 110 does not extend above the top of the sleeve 130 and preferable the bottom of the sleeve 130. This permits the fingers of the user's hand grasping of the bent handle end portion 145 of the knife 140. The knife 140 has the bent handle 145 stowed inside the jar container 110. The handle 145 is loose for grasping by fingers of a hand of the user and is not attached. The spreadable food contents can be a foodstuff such as mayonnaise, jelly, or peanut butter. The inside annular surface of the mouth 115 of the jar 110 also press fit holds the sleeve 130 and ring 135 to keep the knife 140 inside the jar when not in use. The lid 120 can seal the knife 140 and the spreadable food inside the jar for storage in shipping container, store shelf, pantry, or refrigerator. One or more sides of the jar 110 and a bottom attached to the sides define an inside surface with a top opening. The sheath 130 has a top sheath opening at a top of the sheath 130 sized to receive the handheld spreader knife 140. A top sheath opening of the sheath 130 is configured with a same size and shape as a cross-section of the handheld spreader knife 140 to scrape and clean the handheld spreader knife 140 when the handheld spreader knife 140 is slid in the sheath 130. The jar 110 has a lid 120 configured to meet with the top opening of the container 110. While the illustrated lid 120 screws on, the lid 120 can in alternate embodiments attach other ways such as snapping onto the jar 110.

Figure 4:
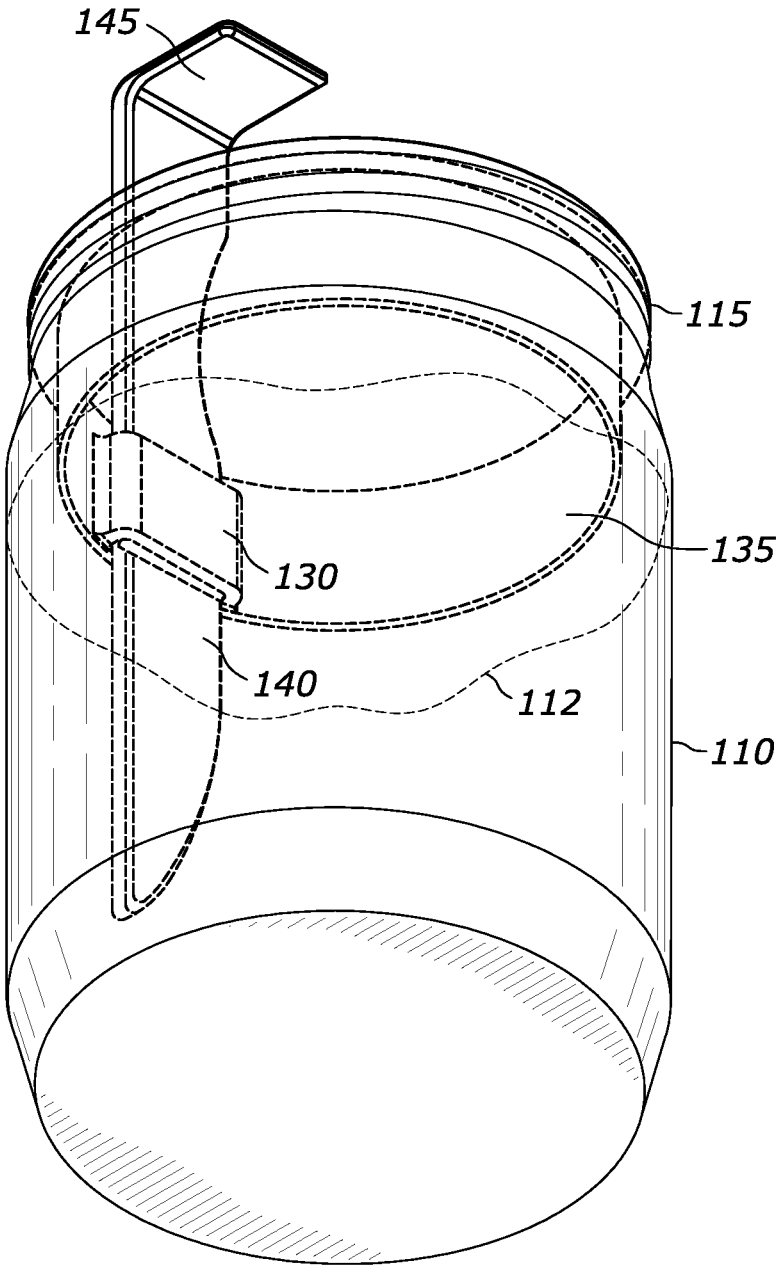
FIG. 4 illustrates a bottom perspective view of the lid and the jar holding the ring with the knife in the sleeve according to the first embodiment of the present inventions.

FIG. 4 illustrates a bottom perspective view of a lid 120 and a container such as a jar 110 holding the ring 135 with the knife 140 in the sleeve 130 of FIG. 3 according to the first embodiment of the present inventions. Like elements have like reference numerals as described in FIG. 3.

Figure 5:
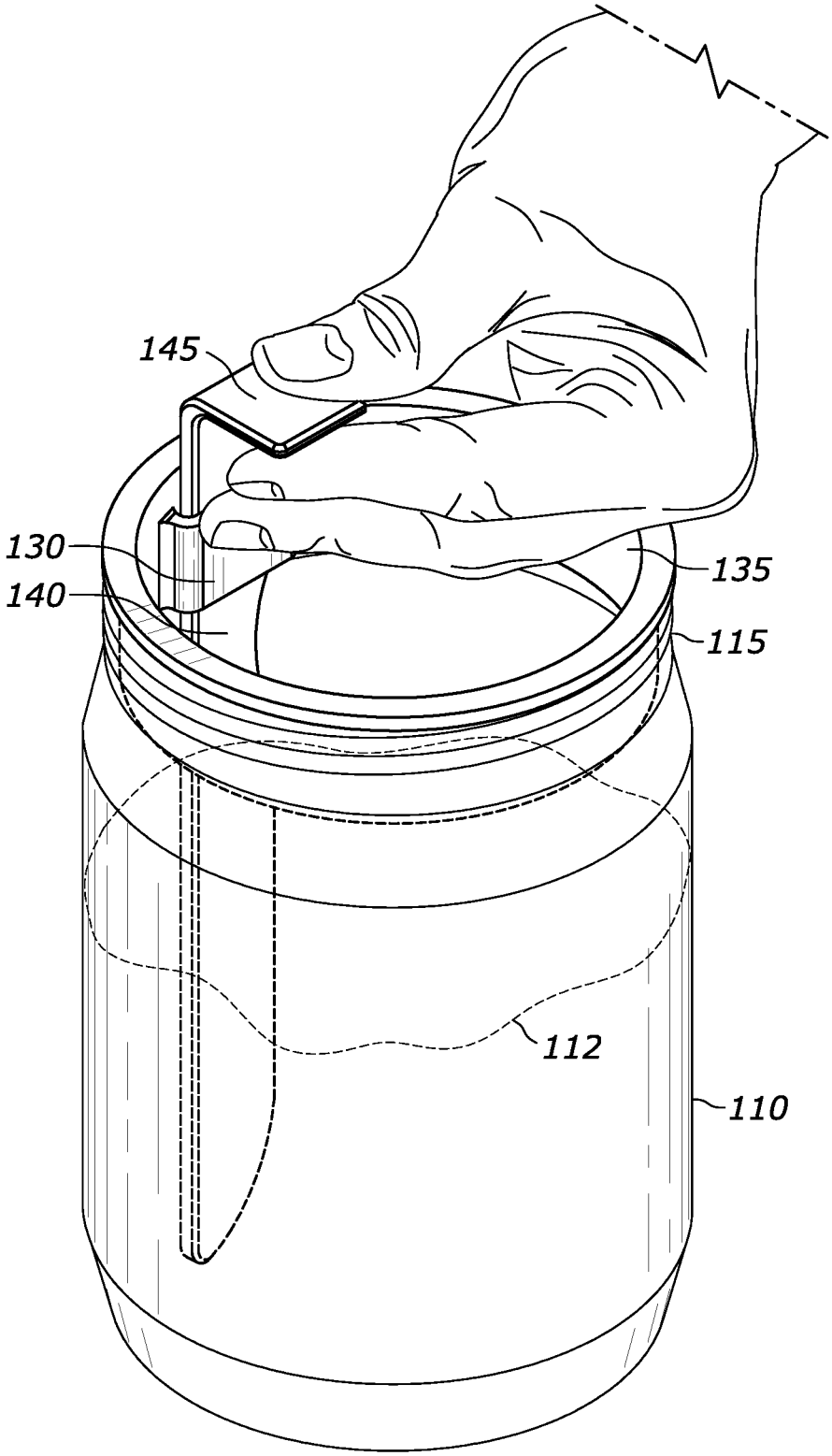
FIG. 5 illustrates a perspective view of a user's fingers grasping a curved handle end of the knife in the sleeve held by the jar according to the first embodiment of the present inventions.

FIG. 5 illustrates a perspective view of a user's fingers grasping a curved handle end 145 of the knife 140 in the sleeve 130 held by the inside annular surface of the mouth 115 of the jar 110 according to the first embodiment of the present inventions. Like elements have like reference numerals as described in FIG. 3.

Figure 6:
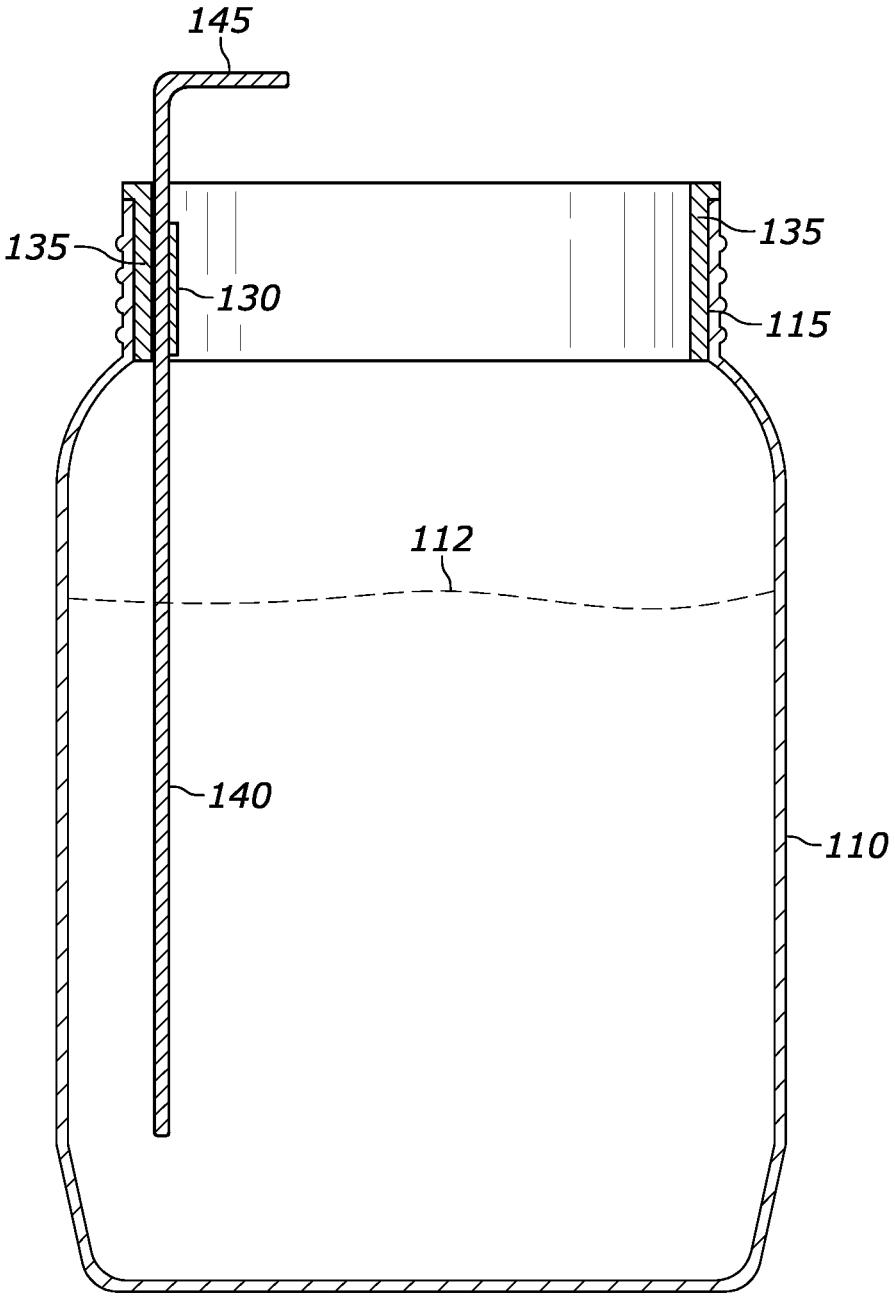
FIG. 6 illustrates a cross-sectional side view of the ring with the knife in the sleeve tightly held in the mouth of a jar according to the first embodiment of the present inventions.

FIG. 6 illustrates a cross-sectional side view of the ring 135 with the knife 140 in the sleeve 130 of FIG. 3 tightly held in the inside annular surface of the mouth 115 of a jar 110 according to the first embodiment of the present inventions. Like elements have like reference numerals as described in FIG. 3. The cross-sectional side view of FIG. 6 illustrates a tight fit of the ring 135 in the mouth 115 of the jar 110. When the ring 135 is formed of a similar color and type of material as the jar 110, the ring 135 becomes indistinguishable from the jar 110 after such tight fit insertion in the mouth 115.

Figure 7:
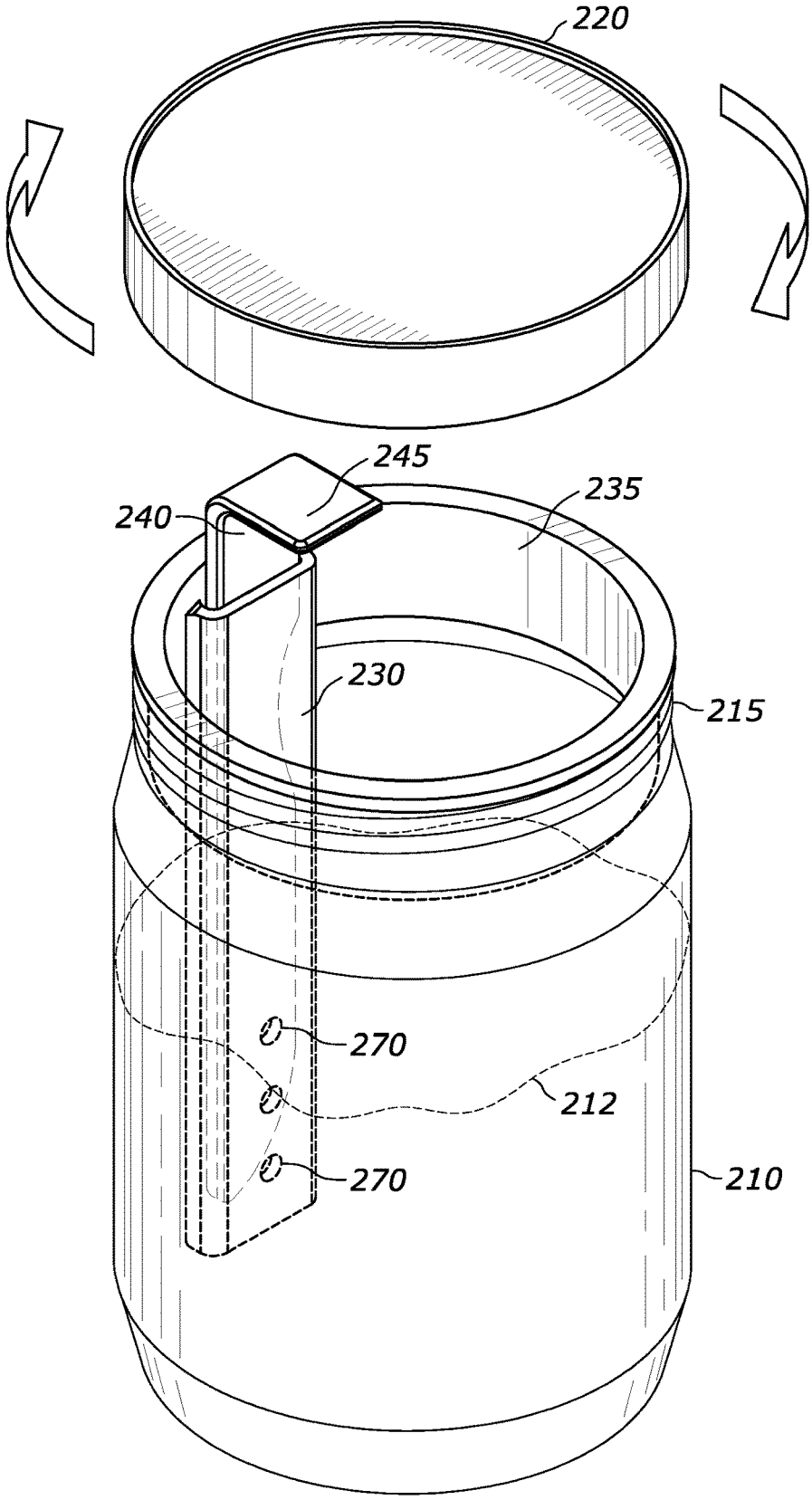
FIG. 7 illustrates a perspective view of a lid and a jar holding a ring with a knife in an extended sleeve according to a second embodiment of the present inventions.

FIG. 7 illustrates a perspective view of a lid 220 and a container such as a jar 210 holding a ring 235 with a knife 240 in an extended sleeve or sheath 230 according to a second embodiment of the present inventions. The jar 210 has one or more container sides and a bottom attached to the sides defining an inside surface with the top mouth opening. In the second embodiment the sleeve is a sheath 230 extended to cover an entirety of a length of the knife blade as illustrated. The sheath 230 can have one or more secondary sheath openings 270 near a bottom of the sheath 230 configured to permit flow of liquid therethrough when the handheld spreader knife 240 is slid in the sheath 230, wherein the liquid comprises at least one or both of the spreadable food and air. In the second embodiment, the ring 235 press fits into the inner annular surface of the mouth 215 of the jar 210. The knife 240 has a handle at an upper portion of the length of the knife. The handle preferably contains a 90 degree bent portion 245, as illustrated. The bent portion 245 of the handle on the upper end of the knife 240 aids the fingers of the hand of a user to grasp the knife 240. Additionally, the bent portion 245 acts as a stop to limit the depth the knife 240 travels down when instated into the jar 210. The bottom tip of the knife 240 can be prevented from touching the bottom of the jar 210 by the stop function of the bent portion of the knife 240. Of course this depends on the length of the knife 240 too. The sheath 230 and ring 235 holds a handheld spreader such as the knife 240 or other utensil inside the jar 210. The jar 210 holds spreadable food up to the top food level 212. The top food level 212 of the foodstuff or other contents of the jar 210 does not extend above the top of the sheath 230. This permits the fingers of the user's hand grasping of the bent handle end portion 245 of the knife 240. The knife 240 has the bent handle 245 stowed inside the jar container 210. The handle 245 is loose for grasping by fingers of a hand of the user and is not attached. The spreadable food contents can be a foodstuff such as mayonnaise, jelly, or peanut butter. The inside annular surface of the mouth 215 of the jar 210 also press fit holds the sleeve 230 and ring 235 to keep the knife 240 inside the jar when not in use. The lid 220 can seal the knife 240 and the spreadable food inside the jar for storage in shipping container, store shelf, pantry, or refrigerator. One or more sides of the jar 210 and a bottom attached to the sides define an inside surface with a top opening. The sheath 230 has a top sheath opening at a top of the sheath 230 sized to receive the handheld spreader knife 240. A top sheath opening of the sheath 230 is configured with a same size and shape as a cross-section of the handheld spreader knife 240 to scrape and clean the handheld spreader knife 240 when the handheld spreader knife 240 is slid in the sheath 230. The jar 210 has a lid 220 configured to meet with the top opening of the container 210. While the illustrated lid 220 screws on, the lid 220 can in alternate embodiments attach other ways such as snapping onto the jar 210.

The ring is particularly adapted to conventional plastic jars. The ring and sleeve are preferably made of plastic. When the ring is formed of the same type of plastic material as the jar container and of the same color as the jar container, they are nearly indistinguishable after the ring is instated, particularly when the ring is sized for a tight fit. These noteworthy advantages allow the ring to be used in conventional jars without modification of the jar.

Unless stated otherwise, terms such as "first" and "second" are used to arbitrarily distinguish between the elements such terms describe. Thus, these terms are not necessarily intended to indicate temporal or other prioritization of such elements.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure.

What is claimed is:

1. An apparatus for a container for holding spreadable food, comprising:

a handheld spreader of an elongated shape, the handheld spreader having a bend located between a handle on an upper end and a spreading surface on an opposing lower end;

a ring shaped to be concentrically press fit into a top mouth opening of an inside annular surface of a container which has one or more container sides and a bottom attached to the sides defining an inside surface with the top mouth opening, the ring comprising a main opening circumferentially formed inside an inner surface of the ring and a holder formed on the inner surface of the ring having at least a top slit opening sized to receive the spreading surface of the handheld spreader, wherein the top slit opening is substantially narrower than the main opening and located at a side edge of the main opening, and wherein an upper edge of the top slit opening is recessed below a top edge of the ring by at least a recess distance sufficient to stow the spreading surface of the handheld spreader through the top slit opening such that the handle rests below the top mouth opening with the handle lying across the main opening facing away from the top slit opening.

2. The apparatus according to claim 1, wherein the top slit opening of the holder of the ring is configured with a same size and shape as a cross-section of the elongated shape of the spreading surface on the lower end of the handheld spreader to scrape and clean the handheld spreader when the handheld spreader is slid in the top slit opening.

3. The apparatus according to claim 1, wherein the holder is a sheath extending about the entirety of the length of the spreading surface on the lower end of the handheld spreader.

4. The apparatus according to claim 3, wherein the sheath further comprises at least one secondary sheath opening near a bottom of the sheath configured to permit flow of liquid therethrough into an interior of the container when the handheld spreader is slid into the slit, wherein the liquid comprises at least one or both of the spreadable food and air.

5. The apparatus according to claim 1, wherein the apparatus further comprises the container in combination with the ring and the handled spreader; and wherein the ring is formed of a same material of a same color as the container.

6. The apparatus according to claim 1, wherein the handle has a horizontal portion of a length longer than a length of the top slit opening of the holder and the bend in the handheld spreader is bent approximately ninety degrees between the handle and the spreading surface.

7. A container for holding spreadable food and a handheld spreader, comprising:

a handheld spreader of an elongated shape, the handheld spreader having a bend located between a handle on an upper end and a spreading surface on an opposing lower end;

a concentric top mouth opening of an inside annular surface of the container, one or more container sides and a bottom attached to the sides defining an inside surface with the top mouth opening;

a ring shaped to be concentrically press fit into the inside annular surface of the top mouth opening of the container;

a main opening circumferentially formed inside an inner surface of the ring and a holder formed on the inner surface of the ring having at least a top slit opening sized to receive the spreading surface of the handheld spreader, wherein the top slit opening is substantially narrower than the main opening and located at a side edge of the main opening, and wherein an upper edge of the top slit opening is recessed below a top edge of the ring by at least a recess distance sufficient to stow the spreading surface of the handheld spreader through the top slit opening such that the handle rests below the top mouth opening with the handle lying across the main opening facing away from the top slit opening; and a lid configured to meet with the top opening of the container with the handheld spreader including its handle fit entirely inside of the container beneath the lid when the lid is affixed onto the top opening of the container.

8. The container for holding spreadable food and a handheld spreader according to claim 7, wherein the top slit opening of the holder of the ring is configured with a same size and shape as a cross-section of the elongated shape of the spreading surface on the lower end of the handheld spreader to scrape and clean the handheld spreader when the handheld spreader is slid in the top slit opening.

9. The container for holding spreadable food and a handheld spreader according to claim 7, wherein the holder is a sheath extending about the entirety of the length of the spreading surface on the lower end of the handheld spreader.

10. The container for holding spreadable food and a handheld spreader according to claim 9, wherein the sheath further comprises at least one secondary sheath opening near a bottom of the sheath configured to permit flow of liquid therethrough into an interior of the container when the handheld spreader is slid into the slit, wherein the liquid comprises at least one or both of the spreadable food and air.

11. The container for holding spreadable food and a handheld spreader according to claim 7, wherein the ring is formed of a same material of a same color as the container.

12. The container for holding spreadable food and a handheld spreader according to claim 7, wherein the handle has a horizontal portion of a length longer than a length of the top slit opening of the holder and the bend in the handheld spreader is bent approximately ninety degrees between the handle and the spreading surface.

13. The apparatus according to claim 1, wherein the handheld spreader is a knife.

14. The container for holding spreadable food and a handheld spreader according to claim 7, wherein the handheld spreader is a knife.

15. The apparatus according to claim 1, wherein the handle has a tip opposite the bend; and wherein the handle rests below the top mouth opening with the tip of the handle lying across the main opening facing away from the top slit opening.

16. The apparatus according to claim 1, wherein the handle has a length sufficient for spreading when grasped between fingers of a user.

17. The apparatus according to claim 1, wherein the handle consists of a straight portion.

18. The container for holding spreadable food and a handheld spreader according to claim 7, wherein the handle has a tip opposite the bend; and wherein the handle rests below the top mouth opening with the tip of the handle lying across the main opening facing away from the top slit opening.

19. The container for holding spreadable food and a handheld spreader according to claim 7, wherein the handle has a length sufficient for spreading when grasped between fingers of a user.

20. The container for holding spreadable food and a handheld spreader according to claim 7, wherein the handle consists of a straight portion.

* * * * *